US009981468B2

(12) United States Patent
Katsuura

(10) Patent No.: US 9,981,468 B2
(45) Date of Patent: May 29, 2018

(54) INK JET PRINTING APPARATUS AND METHOD FOR CONTROLLING INKJET PRINTING APPARATUS

(71) Applicant: CANON KABUSHIKI KAISHA, Tokyo (JP)

(72) Inventor: Joji Katsuura, Kawasaki-shi (JP)

(73) Assignee: Canon Kabushiki Kaisha, Tokyo (JP)

( * ) Notice: Subject to any disclaimer, the term of this patent is extended or adjusted under 35 U.S.C. 154(b) by 90 days.

(21) Appl. No.: 15/226,719

(22) Filed: Aug. 2, 2016

(65) Prior Publication Data

US 2016/0339693 A1 Nov. 24, 2016

Related U.S. Application Data

(62) Division of application No. 13/785,658, filed on Mar. 5, 2013.

(30) Foreign Application Priority Data

Mar. 9, 2012 (JP) ..... 2012-052894

(51) Int. Cl.
*B41J 2/045* (2006.01)
*B41J 2/21* (2006.01)

(52) U.S. Cl.
CPC ..... *B41J 2/04573* (2013.01); *B41J 2/0458* (2013.01); *B41J 2/0459* (2013.01); *B41J 2/04548* (2013.01); *B41J 2/04563* (2013.01); *B41J 2/04586* (2013.01);
(Continued)

(58) Field of Classification Search
USPC ..... 347/14, 11, 9
See application file for complete search history.

(56) References Cited

U.S. PATENT DOCUMENTS 5,867,182 A 2/1999 Nakagawa
6,412,925 B1 * 7/2002 Takahashi ..... B41J 2/04571 347/11
6,422,677 B1 7/2002 Deshpande et al.
6,435,639 B1 * 8/2002 Nakajima ..... B41J 2/2114 347/15
(Continued)

FOREIGN PATENT DOCUMENTS

JP 2001-026120 A 1/2001
JP 2001-191530 A 7/2001
(Continued)

*Primary Examiner* — Matthew Luu
*Assistant Examiner* — Lily Kemathe
(74) *Attorney, Agent, or Firm* — Fitzpatrick, Cella, Harper & Scinto

(57) ABSTRACT

An ink jet printing apparatus is provided which can suppress defective ejection of ink from the nozzles. An element array with a plurality of print elements arranged therein is divided into a plurality of groups of print elements. For each of the plurality of groups, the apparatus determines whether any area undergoes a failure to perform a normal printing operation. If the apparatus determines, for any of the plurality of groups, that any area is likely to undergo the failure, when the print medium is printed based on the print data corresponding to the area, control is performed in such a manner that a first amount of energy supplied to drive one print element is greater than a second amount of energy supplied to drive one print element immediately before the print medium is printed based on the print data corresponding to the area.

17 Claims, 19 Drawing Sheets

(52) U.S. Cl.
CPC ..... *B41J 2/04591* (2013.01); *B41J 2/04598* (2013.01); *B41J 2/2139* (2013.01)

(56) References Cited

U.S. PATENT DOCUMENTS

| | | | | |
|---|---|---|---|---|
| 7,628,462 | B2 * | 12/2009 | Iwao | B41J 2/04581 347/10 |
| 8,814,304 | B2 * | 8/2014 | Miyahara | B41J 2/0452 347/14 |
| 8,926,043 | B2 * | 1/2015 | Mizutani | B41J 2/1753 347/14 |
| 9,254,692 | B2 * | 2/2016 | Fujimoto | B41J 2/07 |
| 2002/0018088 | A1 * | 2/2002 | Takahashi | G06K 15/102 347/15 |
| 2002/0154182 | A1 * | 10/2002 | Takahashi | B41J 2/2132 347/12 |
| 2005/0264593 | A1 * | 12/2005 | Nagamura | B41J 2/0458 347/5 |
| 2006/0056699 | A1 * | 3/2006 | Kusakari | B41J 2/2146 382/190 |
| 2010/0328385 | A1 | 12/2010 | Shibata et al. | |
| 2011/0096115 | A1 * | 4/2011 | Mizutani | B41J 2/1753 347/14 |
| 2015/0336381 | A1 * | 11/2015 | Kyoso | B41J 2/0451 347/14 |
| 2016/0339693 | A1 * | 11/2016 | Katsuura | B41J 2/2139 |

FOREIGN PATENT DOCUMENTS

| | | | |
|---|---|---|---|
| JP | 2004-122533 | A | 4/2004 |
| JP | 2008-055855 | A | 3/2008 |

* cited by examiner

| FIG.8A | FIG.8B |
|---|---|

| | C | M | Y | K |
|---|---|---|---|---|
| DOT COUNT NUMBER USED TO DETERMINE WHETHER AREA IS BLANK AREA OR IMAGE AREA | 0 | 0 | 0 | 0 |

FIG.10

THRESHOLD VALUE (NA) USED TO DETERMINE NUMBER OF CONTIGUOUS BLANK AREAS (N)

| NUMBER OF PASSES | PRINT SPEED [inch/s] | C | M | Y | K |
|---|---|---|---|---|---|
| 1 | 20 | 10 | 10 | 8 | 8 |
| 1 | 40 | 19 | 19 | 16 | 16 |
| 2 | 20 | 10 | 10 | 8 | 8 |
| 2 | 40 | 19 | 19 | 16 | 16 |
| 4 | 20 | 8 | 8 | 6 | 6 |
| 4 | 40 | 16 | 16 | 12 | 12 |

FIG.12

NUMBER OF UNIT AREAS (NB) USED TO DETERMINE AREA OF PREDICTED OCCURRENCE OF DEFECTIVE EJECTION

| NUMBER OF PASSES | PRINT SPEED [inch/s] | C | M | Y | K |
|---|---|---|---|---|---|
| 1 | 20 | 1 | 1 | 2 | 2 |
| 1 | 40 | 2 | 2 | 3 | 3 |
| 2 | 20 | 2 | 2 | 3 | 3 |
| 2 | 40 | 4 | 4 | 7 | 7 |
| 4 | 20 | 6 | 5 | 4 | 4 |
| 4 | 40 | 11 | 9 | 8 | 8 |

FIG.13

SHIFT AMOUNT FOR PULSE TABLE

| NUMBER OF PASSES | PRINT SPEED [inch/s] | SHIFT AMOUNT |
|---|---|---|
| 1 | 20 | 1 |
| 1 | 40 | 2 |
| 2 | 20 | 1 |
| 2 | 40 | 2 |
| 4 | 20 | 1 |
| 4 | 40 | 2 |

FIG.18

INK JET PRINTING APPARATUS AND METHOD FOR CONTROLLING INKJET PRINTING APPARATUS

This application is a divisional of U.S. patent application Ser. No. 13/785,658, which was filed Mar. 5, 2013 (pending), the contents of which are incorporated herein by reference.

BACKGROUND OF THE INVENTION

Field of the Invention

The present invention relates to an ink jet printing apparatus and a method for controlling an ink jet printing apparatus for printing an image while moving a print head capable of ejecting ink.

Description of the Related Art

In an inkjet printing apparatus, if no ink has been ejected from nozzles of a print head for a long time, ink remaining near the nozzles may be dried or thickened, leading to defective ink ejection. In particular, a large-sized printer which prints images on wide print medium is likely to suffer from the situation in which no ink has been ejected from nozzles of a print head for along time. Correspondingly, such a printer is likely to be subjected to defective ink ejection.

Japanese Patent Laid-Open No. 2008-55855 describes a method for setting driving power (the ink ejection power of nozzles) for a print head according to the scan position of the print head in order to suppress defective ink ejection. The method involves detecting, based on image data to be printed, when the scan position of the print head changes from a no image area in which no image is printed to an image area in which an image is printed, and at the time of the detection, temporarily setting the driving power for the print head to a value larger than a regular value. Increasing the driving power of the print head in this manner allows ink to be temporarily intensely ejected so as to maintain an appropriate ink ejection state.

However, depending on a printed image, only some of the nozzles may not eject ink for a long time and may thus be caused to eject ink defectively. If some of the nozzles thus eject ink defectively, the density of the printed image may be uneven.

Japanese Patent Laid-Open No. 2008-55855 detects, for each unit area of the image data, the number of ink ejections corresponding to the area of the image data (the number of ejections corresponds to the number of dots formed by the ejected ink), and based on the number of ejections, determines whether the print area is an image area or a no image area. Furthermore, for the unit area of the image data subjected to determination, the length of the unit area in a sub-scan direction (which corresponds to the direction of the nozzles intersecting with a scan direction of the print head (main scan direction)) is set equal to the length of nozzle lines including all nozzles. Thus, it is difficult to detect when only some nozzles have not ejected ink for a long time. Furthermore, according to a multipass printing scheme of printing a predetermined print area by a plurality of scans carried out the print head, the image data is thinned out during the plurality of scans. Hence, with respect to a single nozzle, a position where ejection is started after no ink has been ejected for a long time may vary among the plurality of scans. Therefore, it is difficult to reliably suppress the defective ejection of ink from the nozzles simply by temporarily increasing the driving power for the print head when the no image area changes to the image area.

SUMMARY OF THE INVENTION

The present invention provides an ink jet printing apparatus and a method for controlling an ink jet printing apparatus which can suppress the defective ejection of ink from the nozzles by adequately increasing the ink ejection power even if only some of the nozzles have not ejected ink for a long time.

In the first aspect of the present invention, there is provided an ink jet printing apparatus which prints an image on a print medium based on print data, the ink jet printing apparatus comprising: print head having at least one element array on which a plurality of print elements for ejecting ink are arranged in a first direction; a scan unit configured to allow the print head to carry out a scan in a second direction intersecting with the first direction; a determination unit configured to determine, for each of a plurality of groups into which the element array is divided, whether a period during which the print elements in the group eject no ink is equal to or greater than a threshold value, based on the print data; and a control unit configured to control an amount of energy supplied to drive one print element, wherein if the determination unit determines that one of the plurality of groups involves a period equal to or greater than the threshold value, when the print medium is printed based on the print data corresponding to the period equal to or greater than the threshold value, the control unit performs control in such a manner that a first amount of energy supplied to drive one print element is greater than a second amount of energy supplied to drive one print element immediately before the print medium is printed based on the print data corresponding to the period equal to or greater than the threshold value.

In the second aspect of the present invention, there is provided an ink jet printing apparatus which prints an image on a print medium based on print data, the ink jet printing apparatus comprising: a print head having at least one element array on which a plurality of print elements for ejecting ink through ejection ports are arranged in a first direction; a scan unit configured to allow the print head to carry out a scan in a second direction intersecting with the first direction; a determination unit configured to determine, for each of a plurality of groups into which the element array is divided, whether any area is likely to undergo a failure to perform a normal printing operation, based on the print data; and a control unit configured to control an amount of energy supplied to drive one print element, wherein if the determination unit determines, for any of the plurality of groups, that any area is likely to undergo the failure, when the print medium is printed based on the print data corresponding to the area, the control unit performs control in such a manner that a first amount of energy supplied to drive one print element is greater than a second amount of energy supplied to drive one print element immediately before the print medium is printed based on the print data corresponding to the area.

In the third aspect of the present invention, there is provided a method for controlling an ink jet printing apparatus, the apparatus comprising: a print head having a plurality of element arrays on each of which a plurality of print elements capable of ejecting ink by being applied with energy are arranged, the print elements being driven based on print data to print an image on a print medium; and a scan unit configured to allow the print head to carry out a scan in a second direction intersecting with the first direction, the method comprising the steps of: determining, for each of a plurality of groups into which the element array is divided, whether a period during which the print elements in the group eject no ink is equal to or greater than a threshold value, based on the print data; and controlling an amount of energy supplied to drive one print element, wherein if the determination step determines that one of the plurality of groups involves a period equal to or greater than the threshold value, when the print medium is printed based on the print data corresponding to the period equal to or greater than the threshold value, controlling step is performed in such a manner that a first amount of energy supplied to drive one print element is greater than a second amount of energy supplied to drive one print element immediately before the print medium is printed based on the print data corresponding to the period equal to or greater than the threshold value.

In the fourth aspect of the present invention, there is provided a method for controlling an ink jet printing apparatus, the apparatus comprising: a print head having a plurality of element arrays on each of which a plurality of print elements capable of ejecting ink by being applied with energy are arranged, the print elements being driven based on print data to print an image on a print medium; and a scan unit configured to allow the print head to carry out a scan in a second direction intersecting with the first direction, the method comprising the steps of: determining, for each of a plurality of groups into which the element array is divided, whether any area is likely to undergo a failure to perform a normal printing operation, based on the print data; and controlling an amount of energy supplied to drive one print element, wherein if the determination step determines, for any of the plurality of groups, that any area is likely to undergo the failure, when the print medium is printed based on the print data corresponding to the area, controlling step is performed in such a manner that a first amount of energy supplied to drive one print element is greater than a second amount of energy supplied to drive one print element immediately before the print medium is printed based on the print data corresponding to the area.

The present invention divides an element array in which a plurality of print elements is arranged is divided into a plurality of groups of print elements. Thus, for each of the groups, timing for increasing the ink ejection power can be optimally. That is, even if only some of the nozzles have not ejected ink for a long time, the ink ejection power can be increased to suppress the defective ejection of ink from the nozzles.

Further features of the present invention will become apparent from the following description of exemplary embodiments (with reference to the attached drawings).

BRIEF DESCRIPTION OF THE DRAWINGS

FIG. 10 is a diagram illustrating a threshold value used to determine whether an area is a blank area or an image area;

FIG. 12 is a diagram illustrating a threshold value used to determine the number of contiguous blank areas;

FIG. 13 is a diagram illustrating the number of unit areas used to determine an area of expected occurrence of defective ejection;

FIG. 18 is a diagram illustrating the amount of shift for the pulse tables in a state in which an intense-ejection pulse is prepared for application and in a state after the intense-ejection pulse has been applied.

DESCRIPTION OF THE EMBODIMENTS

An embodiment of the present invention will be described below based on the drawings.

Figure 1:
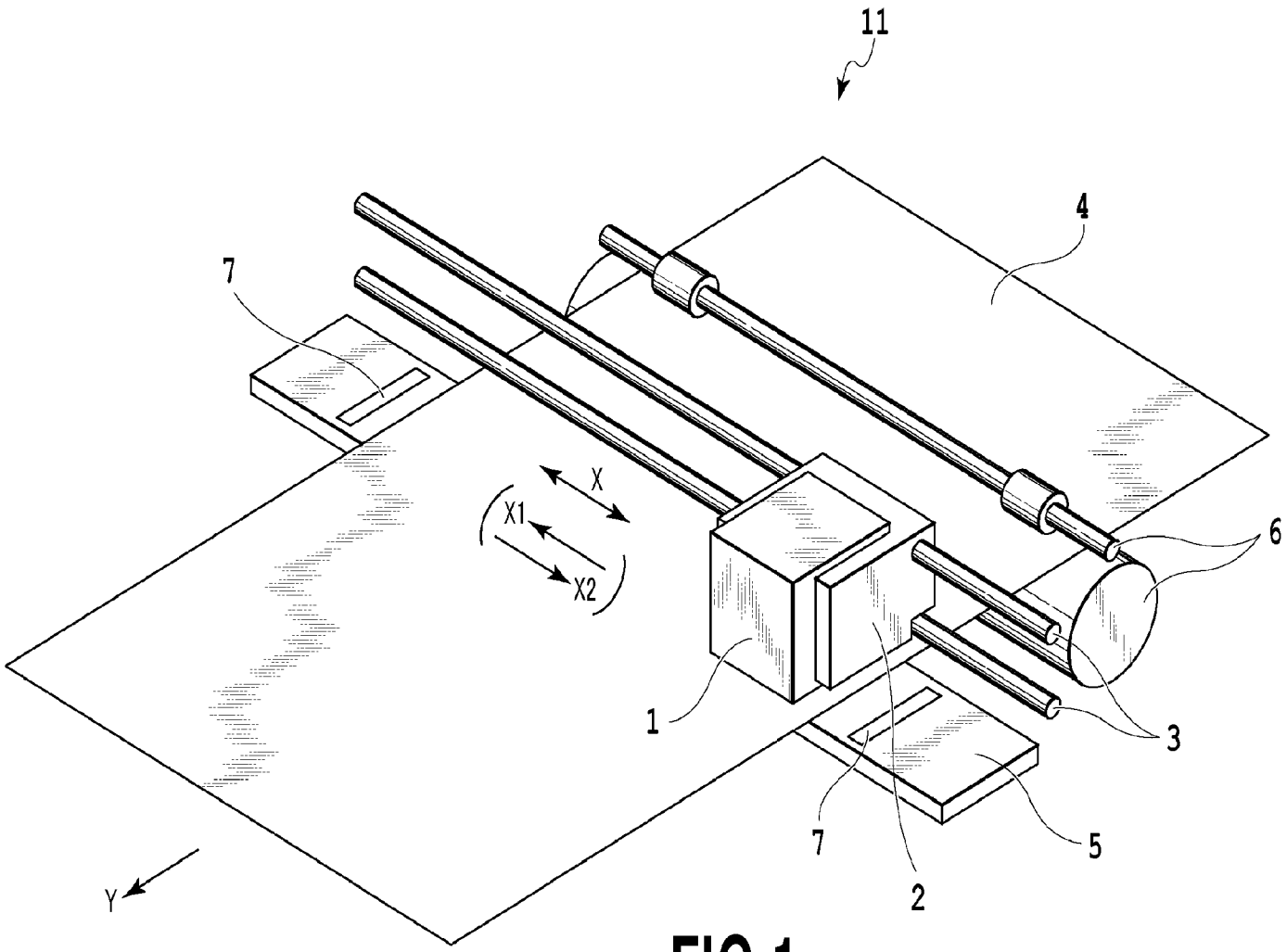
FIG. 1 is a schematic perspective view of an inkjet printing apparatus according to an embodiment of the present invention.

FIG. 1 is a schematic perspective view of a serial ink jet printing apparatus (ink jet printer) 11 to which the present invention is applied. A print head 1 is mounted on a carriage 2, and the carriage 2 moves along a guide shaft 3 in a main scan direction shown by arrow X. During printing of an image, the print medium 4, supported on a platen 5, is intermittently conveyed in a sub-scan direction shown by arrow Y. The serial printing apparatus 11 as in the present example prints an image on the print medium 4 by repeating an operation of conveying the print medium 4 in the sub-scan direction and an operation of allowing the print head 1 to eject ink while moving the print head 1 and the carriage 2 in the main scanning direction. In the main scan direction, the right side in FIG. 1 is defined as a reference side, and the left side in FIG. 1 is defined as a non-reference side. Forward printing refers to a printing operation performed when the carriage 2 moves from the reference side to the non-reference side in a forward direction shown by arrow X1. In contrast, backward printing refers to a printing operation performed when the carriage 2 moves from the non-reference side to the reference side in a backward direction shown by arrow X2. In the present example, a preliminary ejection port 7 is provided at a reference-side position and at a non-reference side position and used for a preliminary ejection operation for recovering the ink ejection performance of the print head 1. In the forward printing, printing of an image is started after execution of the preliminary ejection operation of ejecting ink which does not contribute to the printing, toward the reference-side ejection port 7. On the other hand, in the backward printing, printing of an image is started after execution of the preliminary ejection operation of ejecting ink which does not contribute to the printing, toward the non-reference-side ejection port 7.

Figure 2:
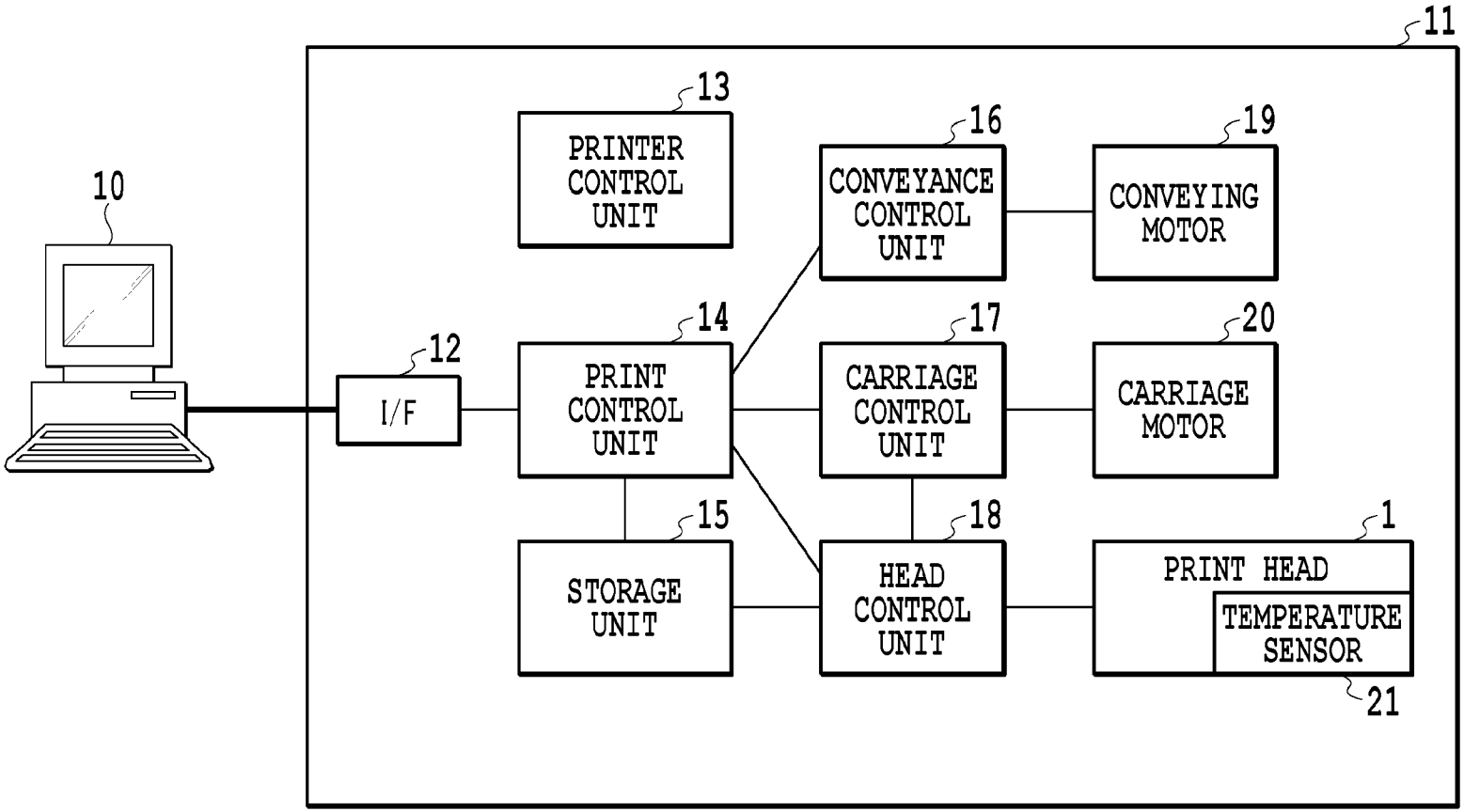
FIG. 2 is a block diagram of a control system in the printing apparatus in FIG. 1.

FIG. 2 is a block diagram of a control system in the printing apparatus in FIG. 1. A host apparatus 10 transmits print data to the printing apparatus (hereinafter also referred to as the printer) 11. A printer control section 13 controls the overall processing in the printer 11. An I/F (interface) 12 receives the print data from the host apparatus 10. The print data transmitted by the host apparatus 10 is horizontal raster data. A print control section 14 converts the print data into vertical data (column data) which can be easily printed by the print head 1. The print control section 14 then stores the vertical data in a print buffer in a storage device 15. At this time, an amount of image data which can be printed within a single scan is divided into a plurality of unit areas in a scan direction and in a nozzle line direction (the direction of an element array). The number of ink ejections applied to each of the unit areas is counted based on the image data. The number of ink ejections corresponds to the number of dots formed by the ejected ink and is thus hereinafter also referred to as the "number of dots".

The print control section 14 determines a print method based on the print data transmitted by the host apparatus 10 and information accompanying the print data. The determination of the print method includes setting of the number of passes in a multipass printing scheme, and a print density and a carriage moving speed (hereinafter also referred to as a print speed) which are suitable for intended printing such as high-definition printing or simplified printing. The print control section 14 controls a conveyance control section 16 and a carriage control section 17 according to the determined print method. The conveyance control section 16 drives a conveying motor 19 for a sheet feeding roller 6 to allow the print medium to be conveyed in the sub-scan direction. The carriage control section 17 drives a carriage motor 20 to move the carriage 2 in the main scan direction. A head control section 18 reads print data from the storage device 15 and transfers the print data to the print head 1, in conjunction with movement of the carriage 2. Thus, an image can be printed on the print medium 4 at a desired position. Furthermore, the print head 1 includes a temperature sensor 21 and allows the temperature of ejected ink to be estimated based on detection by the temperature sensor 21.

Figure 3:
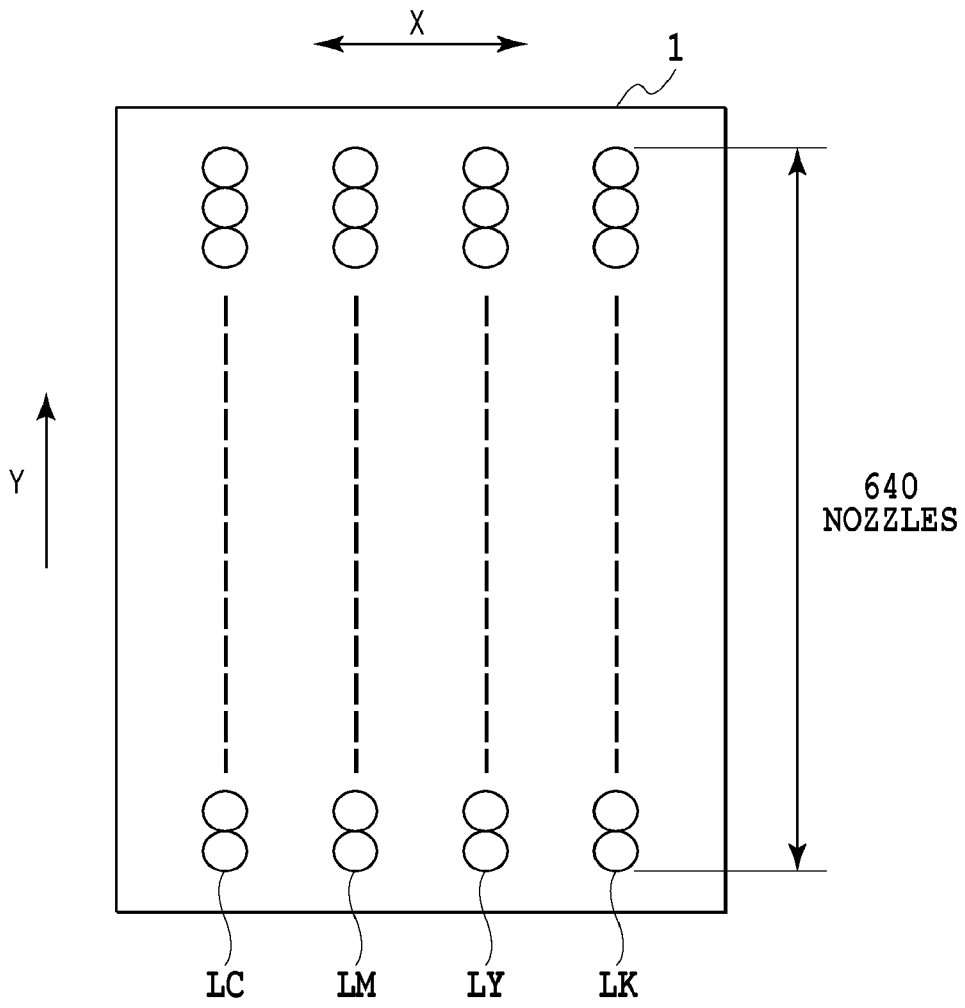
FIG. 3 is a diagram illustrating a print head in FIG. 1 as viewed from a print medium.

FIG. 3 is a view illustrating nozzles which is obtained when the print head 1 is viewed from the print medium 4 side. The print head 1 includes nozzle lines formed therein and in which a plurality of nozzles capable of ejecting ink are arranged in a direction crossing to the main scan direction (in the present example, the sub-scan direction, which is orthogonal to the main scan direction). The print head 1 prints an image on the print medium 4 by selectively ejecting ink from the nozzles while moving in the main scan direction. In the present example, the print head 1 includes nozzles from which a cyan (C) ink, a magenta (M) ink, a yellow (Y) ink, and a black (K) ink are ejected and which are arranged to form nozzle lines LC, LM, LY, and LK. Each of the nozzle lines includes 640 nozzles arranged therein. An image can be printed by selectively ejecting ink from the nozzles based on the print data to form dots on the print medium 4. Ink ejected from the 640 nozzles allows 640 dots to be formed in the sub-scan direction. The configuration of the print head 1, the type of the ejected ink, and the like are not limited to the present example.

Moreover, each of the nozzles includes print elements provided therein and supplied with energy to generate ejection power required to eject ink. The plurality of print elements are arranged so as to form an element array.

Figure 4:
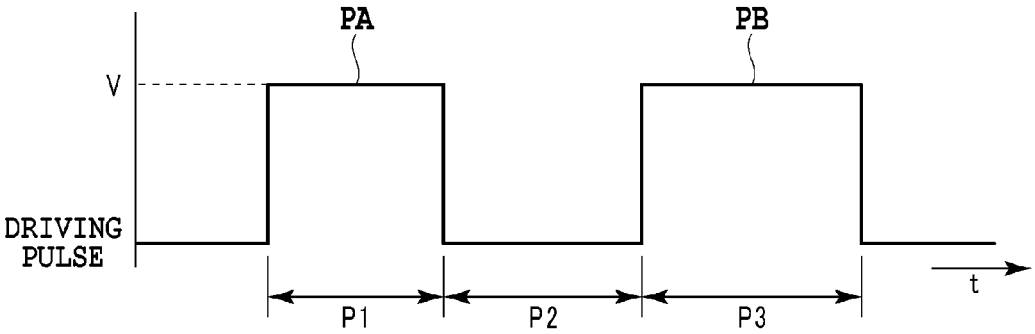
FIG. 4 is a diagram illustrating a driving pulse for ink ejection.

The print head 1 in the present example includes electrothermal transducing elements (heaters) as print elements provided in each nozzle. The heaters are supplied with energy to generate heat to bubble the ink in the nozzle. The resulting bubbling energy can be utilized to eject the ink from an ejection port at the tip of the nozzle. The heaters independently provided in each nozzle are driven by a driving pulse of a predetermined voltage V as shown in FIG. 4. In the present example, the driving pulse includes a pre-pulse PA and a main pulse PB. The pre-pulse PA warms ink located near the surface of each of the heaters. The main pulse bubbles the ink to allow the ink to be ejected through the ejection port. Ink ejection volume can controlled by modulating the width P1 of the pre-pulse, the width P2 of interval, and the width P3 of the main pulse (pulse width modulation) to change the ink ejection power. Elevated temperature reduces the viscosity of the ink and thus tends to increase the ink ejection volume. The elevated temperature of the print head 1 raises the temperature of the ink. Thus, when the same energy is supplied to drive the heaters, the ink ejection volume increases. However, an increase in ink ejection volume can be suppressed by modulating the width P1 of the pre-pulse PA to reduce the ejection power. In the present example, the driving pulse can be controlled for the 640 nozzles in the nozzle line unit at the same time. That is, in the present example, the unit number of nozzles, the ejection power of which can be controlled, is 640, and the ejection power can be controlled for every unit number of nozzles. The driving pulse may be controlled for each nozzle. However, in this case, a relevant electric circuit is large and complicated.

Figure 5:
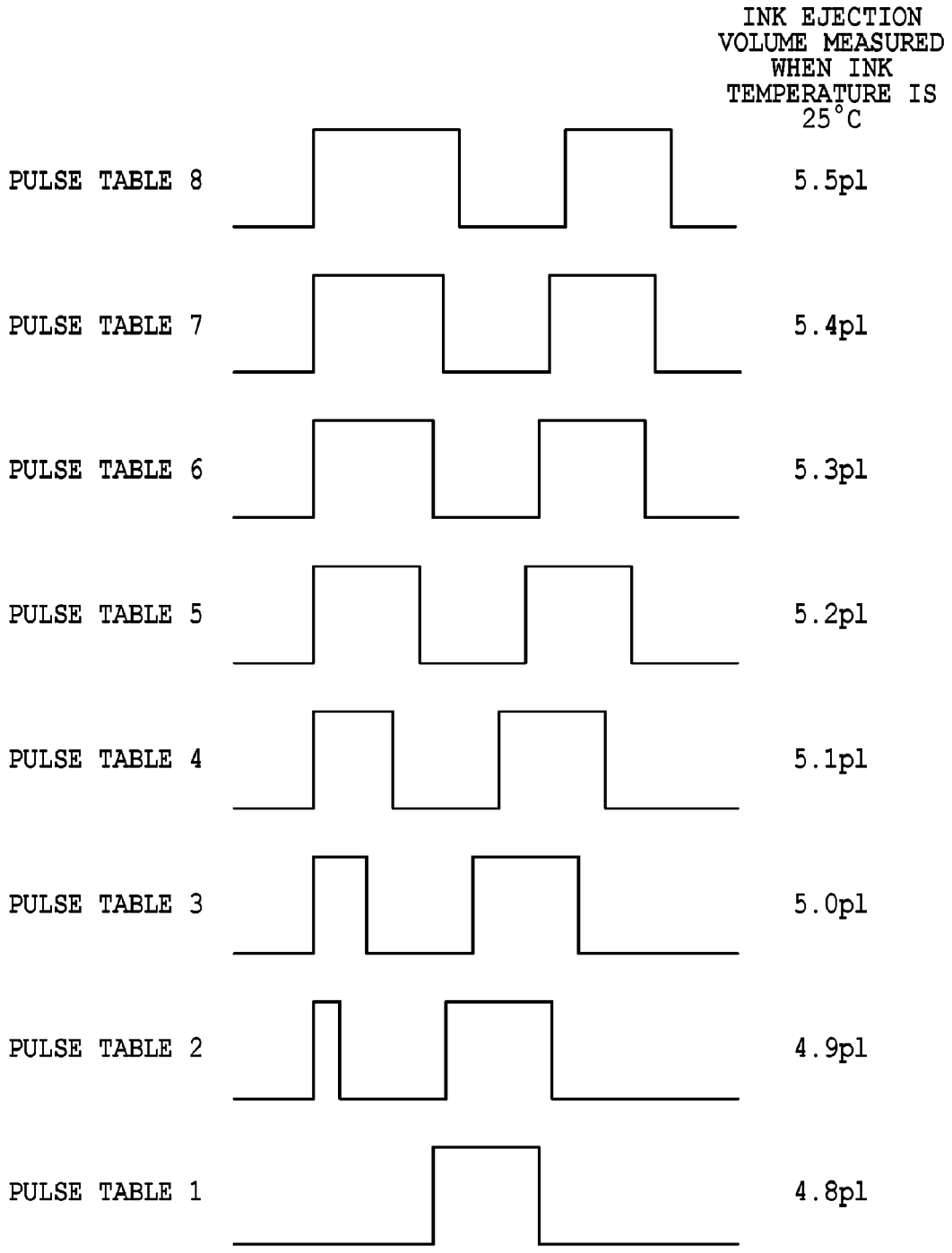
FIG. 5 is a diagram illustrating pulse waveforms individually corresponding to a plurality of pulse tables.

FIG. 5 is a diagram illustrating a plurality of pulse tables for use in modulation of the driving pulse. The intensity of the ink ejection power applied to the heater increases consistently with the number of the pulse table, that is, from pulse table 1 to pulse table 8. FIG. 5 also shows the amount of ink, in a single droplet, ejected (ejection volume) by applying the driving pulse in each of the pulse tables to the heater when the temperature of the ink in the print head is 25° C. This indicates that the ink ejection volume increases consistently with the pulse table number, that is, from pulse table 1 to pulse table 8. The driving pulse in pulse table 1 has a pre-pulse width P1 of "0" and drives the heater only by the main pulse PB. On the assumption that the ink is to be ejected, the intensity of the ink ejection power cannot be reduced below the intensity of the driving pulse 1 in pulse table 1. Pulse tables 1 to 5 are used to modulate the pulse width P1 according to the ink temperature in order to compensate for the ink ejection amount according to the ink temperature. That is, these pulse tables are used to apply a pulse which keeps the ink ejection volume constant (the "normal pulse" described below). On the other hand, pulse tables 6 to 8 are used to apply a pulse which enhances the ink ejection power (the "intense-ejection pulse" described below).

Print heads have individual differences, and thus the pulse tables may be set for each of the ink ejection characteristics of the print head. Furthermore, when the ink is ejected from a large number of nozzles at the same time, printing may be affected by a drop in the driving voltage for the heaters. Thus, the pulse tables may be set to contain correction values corresponding to the number of nozzles from which the ink is ejected at the same time. Furthermore, the present example adjusts the ink ejection power corresponding to the ink ejection amount by using the electrothermal transducing elements (heaters) as ink energy generating elements and using the pulse tables to modulate the driving pulse (heat pulse). However, piezo elements or like may be used as ejection energy generating elements. In this case, the ink ejection power corresponding to the ink ejection amount can be adjusted by adjusting the voltage value of the driving voltage to adjust the amount of energy supplied to the print elements.

Figure 6B:
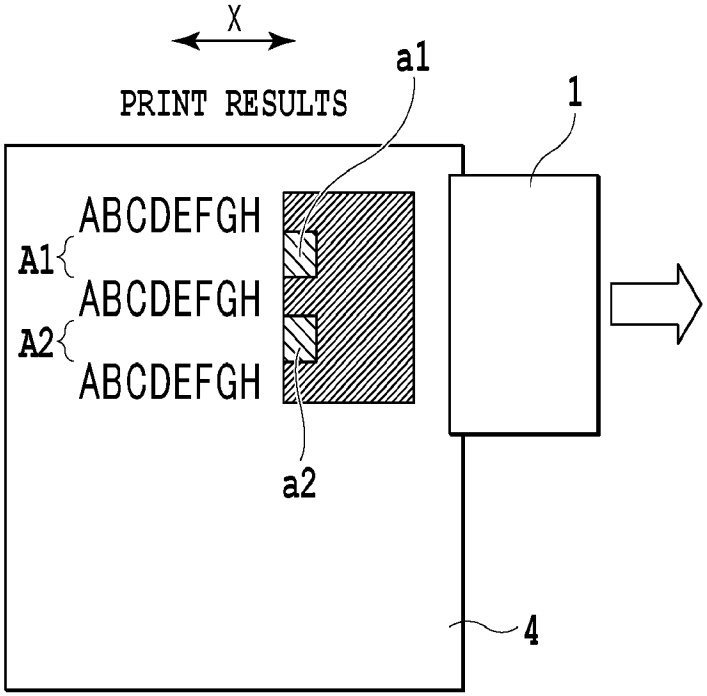
FIG. 6B is a diagram illustrating a printed image resulting from defective ejection of ink from some nozzles.
Figure 6A:
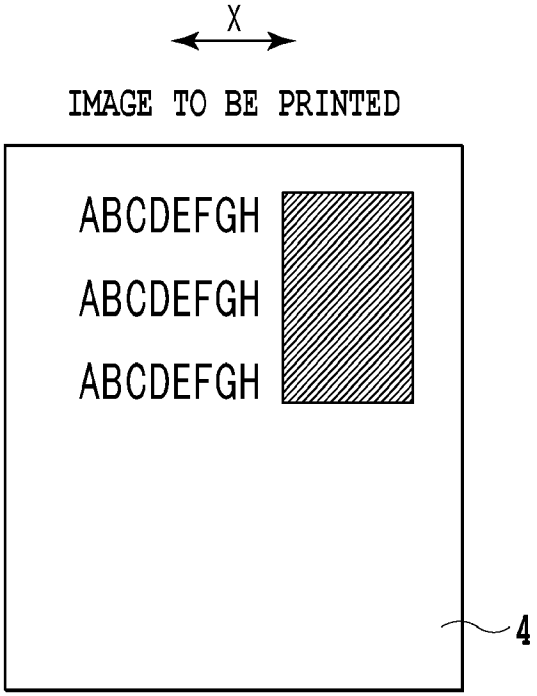
FIG. 6A is a diagram illustrating an original image to be printed.

FIG. 6A and FIG. 6B illustrate degradation of a printed image resulting from defective ejection of ink from the nozzles. Such an original image to be printed as shown in FIG. 6A may be subjected to a reduction in the amount of ink ejected from some of the nozzles in the print head 1. This may lead to print results with degraded image quality as shown in FIG. 6B. The relation between print areas A1 and A2 and the scan direction in FIG. 6B causes a reduced amount of ink to be ejected when the ink ejection is started after a long continued state in which no ink is ejected. This may lead to degraded image quality.

Figure 7:
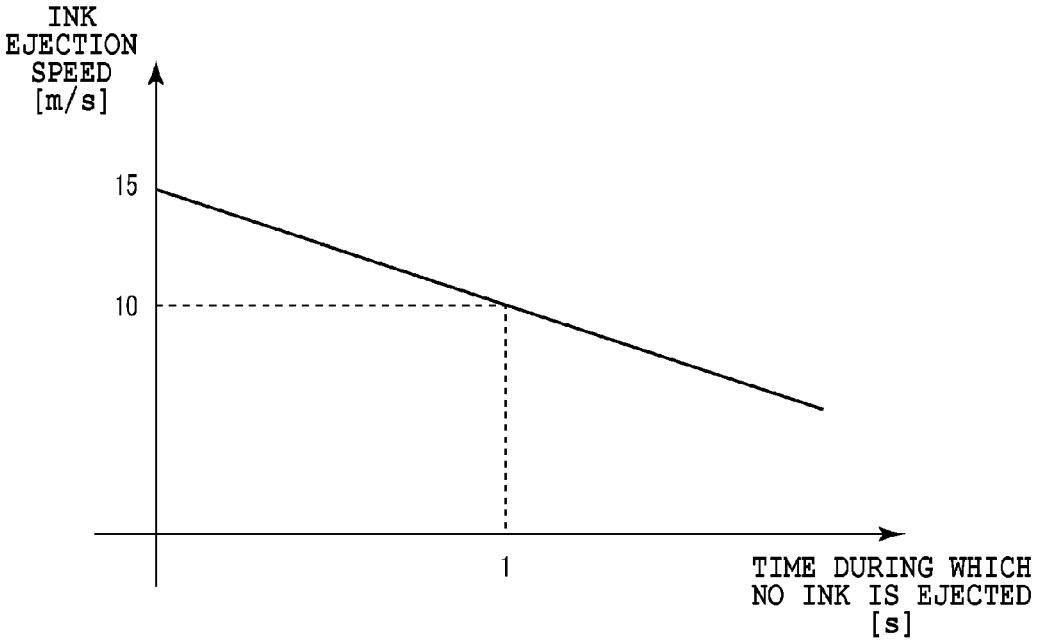
FIG. 7 is a diagram illustrating a relationship between the time during which no ink is ejected and the speed of ink ejection following the time during which no ink is ejected.

FIG. 7 is a diagram illustrating the relation between the time while no ink is ejected from the nozzles and the ejection speed at which the ink is ejected after the time. When no ink is ejected from one nozzle for a long time (no-ejection period), for example, the ink in the nozzle is thickened to cause a reduced amount of ink to be ejected when ink is ejected after the non-ejection period. The reduction in ink ejection volume can be observed as a reduction in ink ejection speed. A certain reduction in ink ejection speed results in a significant deviation in landing position of the ejected ink, which corresponds to a visually perceived degraded image quality. For example, if a measure against degraded image quality is required when the ink ejection speed is at most 10 m/s; some measure needs to be taken when a situation in which no ink is ejected continues 1 second, which corresponds to 10 m/s.

The defective ink ejection can be eliminated because the ejection speed can be increased by appropriately enhancing the ink ejection power. On the other hand, in FIG. 6B, portions a1 and a2 of the print areas A1 and A2 in which image quality is degraded appear as faces extending in the scan direction. This may be because, for example, according to a multipass printing scheme of printing a predetermined print area by the print head carrying out a plurality of scans, image data may be thinned out during the plurality of scans. That is, a line of image extending through the portion a1 in the main scan direction is printed by a plurality of scans with ink ejected from a plurality of nozzles. The timing when the nozzle stopped from ejecting ink starts ink ejection may vary among the plurality of nozzles. Thus, a variance in the position of defective ejection of ink from the nozzles occurs among the plurality of nozzles, with the portion a1 appearing as a face extending in the scan direction. This also applies to the portion a2. Such a phenomenon needs to be taken into account if the amount of energy supplied to the heaters is changed to enhance the ink ejection power in order to eliminate the defective ink ejection.

Figures 8, 8A:
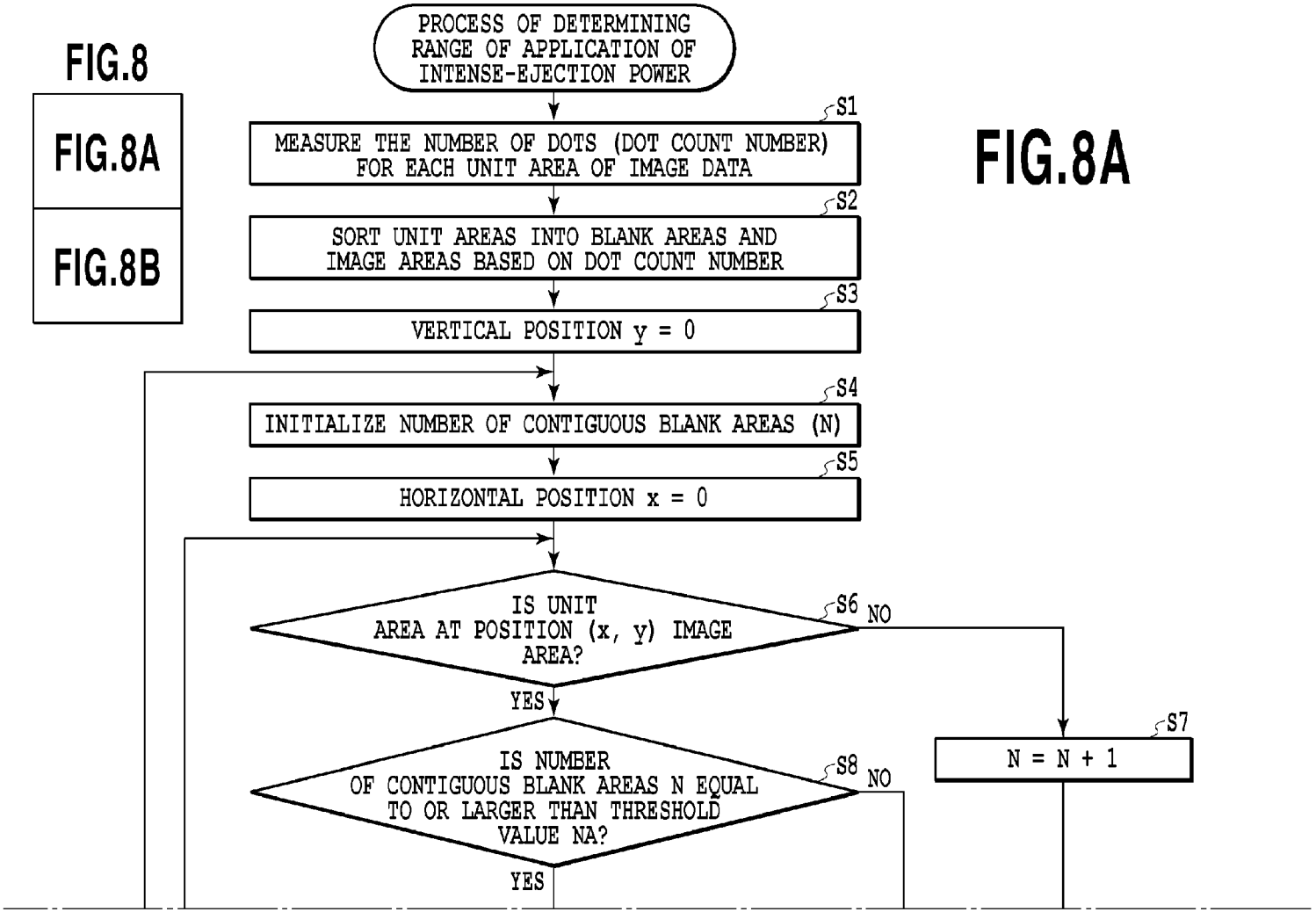
FIG. 8 is a diagram showing the relationship between FIG. 8A and FIG. 8B.
FIG. 8A is a flowchart illustrating a process of determining the range of application of intense-ejection power.
Figure 8B:
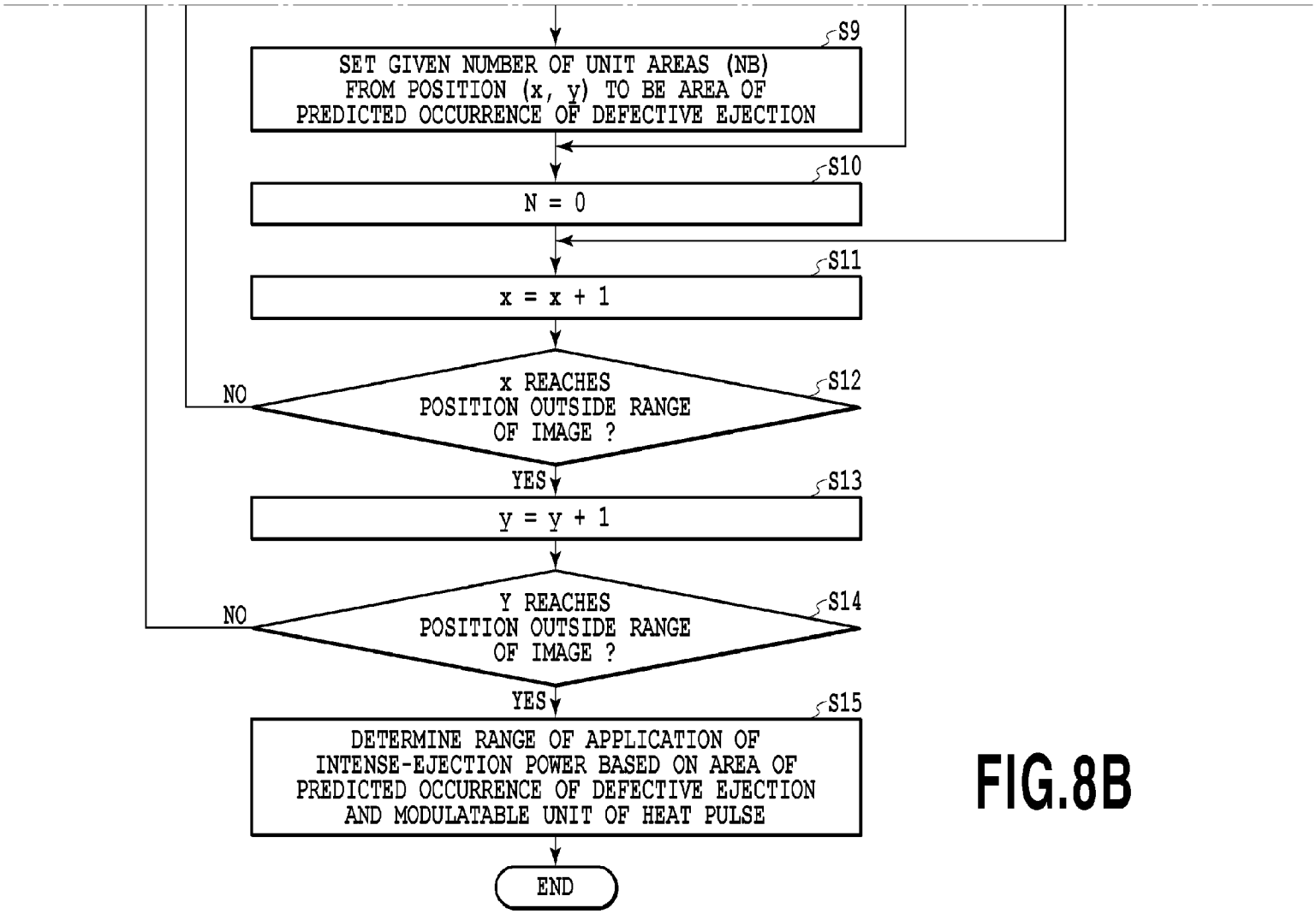
FIG. 8B is a flowchart illustrating a process of determining the range of application of intense-ejection power.

FIG. 8A and FIG. 8B are flowcharts illustrating a process of determining the range within which the ink ejection power is enhanced (the "range of application of intense ejection power" described below) by changing the amount of energy supplied to the heaters. The process shown in FIG. 8 A and FIG. 8B is carried out by the print control section 14. The process in FIG. 8 A and FIG. 8B is actually carried out independently for each of the nozzle lines LC, LM, LY, and LK. In the following description, the process is assumed to be carried out on one nozzle line (for example, the nozzle line LK) unless necessary.

Figure 9:
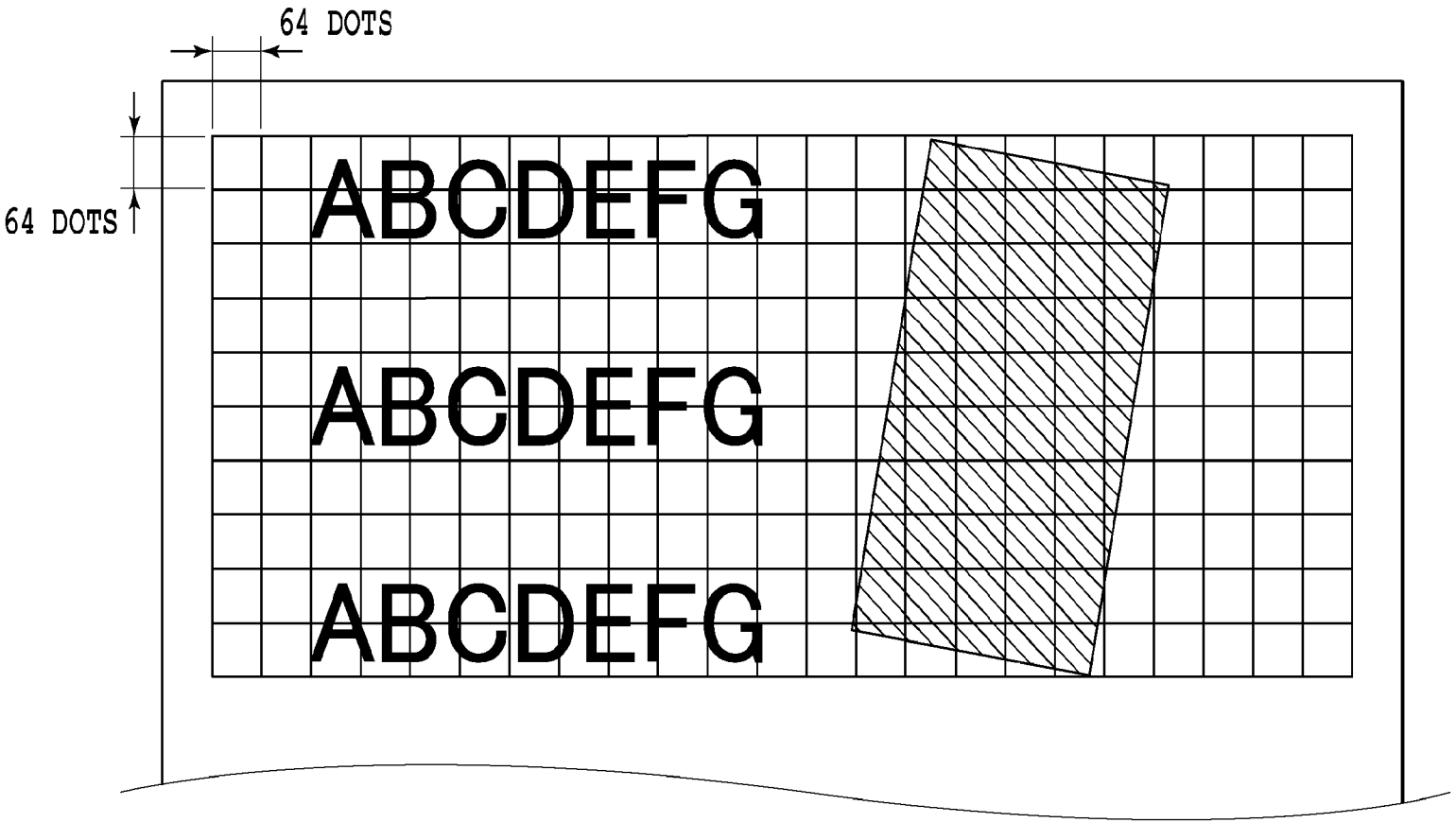
FIG. 9 is a diagram illustrating an example of image data divided into unit areas.

First, when the print control section 14 converts image data into column data and stores the column data in the storage device 15, the number of dots in unit area (in the present example, a 64 dot×64 dot area) is counted (dot counting) (step S1). The number of dots (dot count number) corresponds to the number of ink droplets ejected for every unit area of image data based on the image data as described above. FIG. 9 shows an example of image data divided into unit areas (64 dots×64 dots). The dot count number is measured for each of the unit areas. The unit area corresponds to a print range in a printing area capable of being printed by a single movement of the print head, and the printing area is divided, in each of the direction of the nozzle lines and the scan direction, into a plurality of the print ranges corresponding to the unit areas. Each unit area is printed by a plurality of groups into which the element array is divided. Thus, the unit area of image data is also referred to as the "unit data area". The dot count number is measured for each unit data area.

Figure 11:
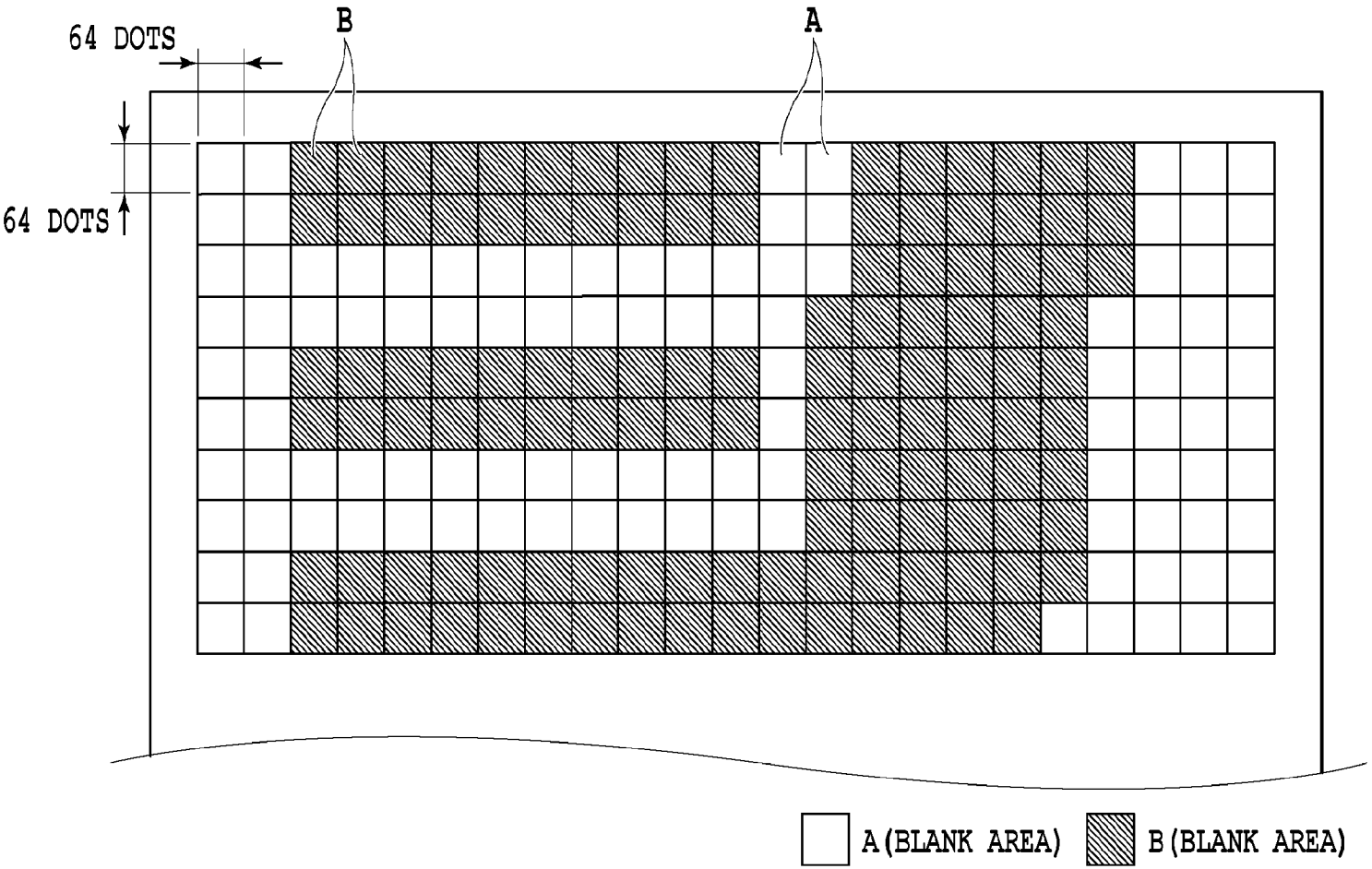
FIG. 11 is a diagram illustrating that the unit areas of the image data shown in FIG. 9 are sorted into blank areas and image areas.

Then, in step S2 in FIG. 8A, the unit areas are sorted into blank areas A and image areas B based on the dot count number for each unit area measured in step S1. For the sorting, a table of threshold values shown in FIG. 10 is used. If the dot count number for a unit area is equal to or smaller than the threshold values in FIG. 10, the unit area is determined to be a blank area A. On the other hand, if the dot count number for a unit area is larger than the threshold values in FIG. 10, the unit area is determined to be an image area B. In the example in FIG. 10, the values in the table are all "0"s. Thus, if even one dot is formed in a unit area, the unit area becomes an image area. FIG. 11 shows the results of sorting of the unit areas of the image in FIG. 9 into blank areas A and image areas B. In FIG. 11, the image areas B are blacked out. Excessively large threshold values in the table in FIG. 10, for example, a print area of a vertical line is not viewed as image areas. On the other hand, if the threshold values are excessively small, for example, when the blank between lines in a text image, corresponding to the distance between the lines, is equivalent to at most 64 dots, the area between the lines is not viewed as a blank area. With these tendencies taken into account, the threshold values are determined. In FIG. 10, the threshold value can be changed for each of the ink colors C, M, Y, and K. However, the present embodiment may be configured to allow the parameters in FIG. 10 to be changed according to the printing method and the purpose of the printing (printing of line drawings, texts, or the like).

Figure 14:
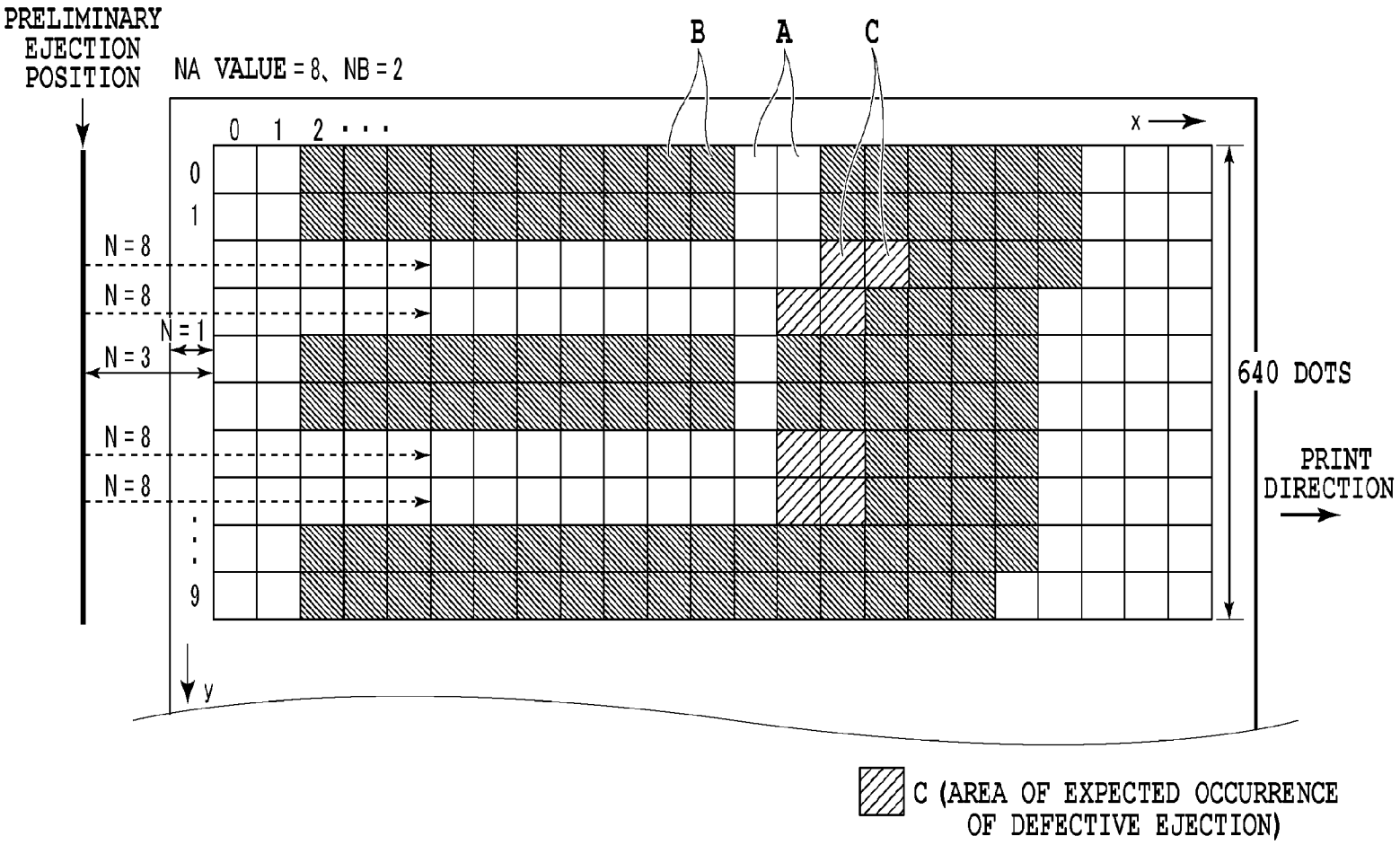
FIG. 14 is an area of expected occurrence of defective ejection determined based on data shown in FIG. 11.

Then, the processing in steps S3 to S14 in FIG. 8A and FIG. 8B are carried out on all the unit areas involved in one scan to determine areas of expected occurrence of defective ejection C described below. The positions of the unit areas involved in one scan are represented by variables x and y as shown in FIG. 14. The variable x represents the position in the main scan direction, and is set to 0, 1, 2, . . . in order according to the passage of the print head in the printing direction. The variable y represents the position in the sub-scan direction and is set to 0, 1, 2, . . . in order from the uppermost area toward the lowermost area of the image data. In the present example, one scan forms 640 dots in the sub-scan direction, and the unit area is 64 dots×64 dots. Thus, the processing is repeatedly carried out on 10 unit areas in the sub-scan direction, that is, 10 unit areas with y of 0 to 9. That is, the processing is repeated until a determination condition in step S14 becomes y>9. The variable y is initialized, counted up, and subjected to the determination process in steps S3, S13, and S14, respectively. The variable x is initialized, counted up, and subjected to the determination process in steps S5, S11, and S12, respectively.

First, processing in steps S4 to S12 carried out with the position y in the sub-scan direction fixed will be described.

In step S4, the number of contiguous blank areas N is initialized by a value corresponding to the distance from a preliminary ejection position (the position of the preliminary ejection port 7) to a position where printing of image data is started. As described above, before printing of an image, a preliminary ejection operation for recovering the ink ejection capability is performed on the preliminary ejection port 7, located outside the range of the print medium 4. For the blank areas A, the number of contiguous blank areas N counted from the last ink ejection is determined. For the blank areas at the head of the image, the number of contiguous blank areas N is determined by adding the number of blank areas equivalent to the distance between the position of the preliminary ejection and the position where printing of the image data is started. In the present example, the distance between the position of the preliminary ejection and the position where printing of the image data is started is equivalent to three blank areas as shown in FIG. 14. Thus, in step S4, the number of contiguous blank areas N is initialized to "3".

In steps S6 to S10, the position x in the main scan direction, sequentially managed along the print direction by steps S5, S11, and S12, is initialized, counted up, and subjected to a determination process. First, step S6 determines whether or not the unit area at the position (x, y) is an image area B. When the unit area is a blank area A instead of an image area B, "1" is added to the number of contiguous blank areas N. When step S6 determines that the unit area is an image area A, step S8 determines whether or not the number of contiguous blank areas N is equal to or larger than a predetermined threshold value (first predetermined number) NA. That is, step S8 determines whether or not the length of the period while the nozzles are unused which is predicted from the image data is equal to or larger than the threshold value. The threshold value NA may be a value in the table in FIG. 12.

The threshold value NA in FIG. 12 is set for each of the ink types (C, M, Y, and K), for each number of passes (the number of passes in the multipass printing scheme (the number of scans)), and for each print speed. The threshold value NA is set for each ink type because the tendency of degradation of the ink ejection capability of the nozzles as shown in FIG. 7 varies depending on the ink type. Furthermore, the threshold value NA is set for each number of passes because an increased number of passes increases the degree to which the print data is thinned out to reduce the use frequency of the nozzles, making the ink ejection capability of the nozzles likely to be degraded. Additionally, the threshold value NA is set for each print speed because the degradation of the ink ejection capability of the nozzles depends on the elapse of time, so that time required for the nozzles to pass through the unit area varies depending on the print speed. In the present example, the degree of degradation of the ink ejection capability of the nozzles is determined based on the number of contiguous blank areas N. However, the degradation of the ink ejection capability depends on elapsed time (the period while the nozzles are unused), and thus the degree of degradation of the ink ejection capability may be determined by comparing the elapsed time with a predetermined threshold value. In this case, based on the number of contiguous blank areas N and the print speed, the time required for the nozzles to pass through the blank areas may be calculated and compared with the threshold value. In addition, the threshold value NA as shown in FIG. 12 may be set according to, besides the ink color, the number of passes, and the print speed, the printing method, the purpose of the printing, and the contents of the printing.

When step S8 determines that the number of contiguous blank areas N is equal to or larger than the threshold value NA, step S9 defines the areas of expected occurrence of defective ejection C as a predetermined number (second predetermined number) NB of unit areas counted from the end of the contiguous blank areas in the print direction. That is, when the number of contiguous blank areas is equal to or larger than the first predetermined number, the areas of expected occurrence of defective ejection C are defined as a second predetermined number of unit areas counted from the end of the contiguous blank areas in the scan direction. The number of unit areas NB is determined using the table in FIG. 13. Like the threshold value NA in FIG. 12, the number of unit areas NB in FIG. 13 is set for each ink color, for each number of passes, and for each print speed. The numbers of unit areas NB is set for each ink color because the time required to recover the ink ejection capability of the nozzles varies depending on the type of ink and because extension of this time tends to increase the area in which ink is defectively ejected. Furthermore, the number of unit areas NB is set for each number of passes because an increased number of passes increases the degree to which the print data is thinned out and the degree of a variance in ink ejection position during each pass, resulting in a tendency to increase the area in which defective ink ejection occurs. Additionally, the number of unit areas NB is set for each print speed because the recovery of the ink ejection capability depends on time. The number of unit areas NB itself is stored in the table in FIG. 13. However, measured time used to determine the number of unit areas NB may be stored in the table in FIG. 13. In this case, the number of unit areas NB may be determined from the print speed and the measured time. In addition, the number of unit areas NB as shown in FIG. 13 may set according to, besides the ink color, the number of passes, and the print speed, the printing method, the purpose of the printing, and the contents of the printing.

After the areas of expected occurrence of defective ejection C are set in step S9, the number of contiguous blank areas N is set, in step S10, to "0". If step S8 determines that the number of contiguous blank areas N is not equal to or larger than the threshold value NA, the number of contiguous blank areas N is also set, in step S10, to "0".

FIG. 14 is a diagram illustrating the results of application of the processing in steps S3 to S14 in FIG. 8A and FIG. 8B to the image data in FIG. 11. FIG. 14 is a diagram of a case where the number of passes, the print speed, and the ink color are "1", 20 inches/s, and black (K), respectively. The tables in FIG. 12 and FIG. 13 show that the threshold value NA used to determine the number of contiguous blank areas is "8" and that the numbers of unit areas NB used to determine the area of expected occurrence of defective ejection is "2". In FIG. 14, areas determined to be the areas of expected occurrence of defective ejection C are shaded.

Figure 15:
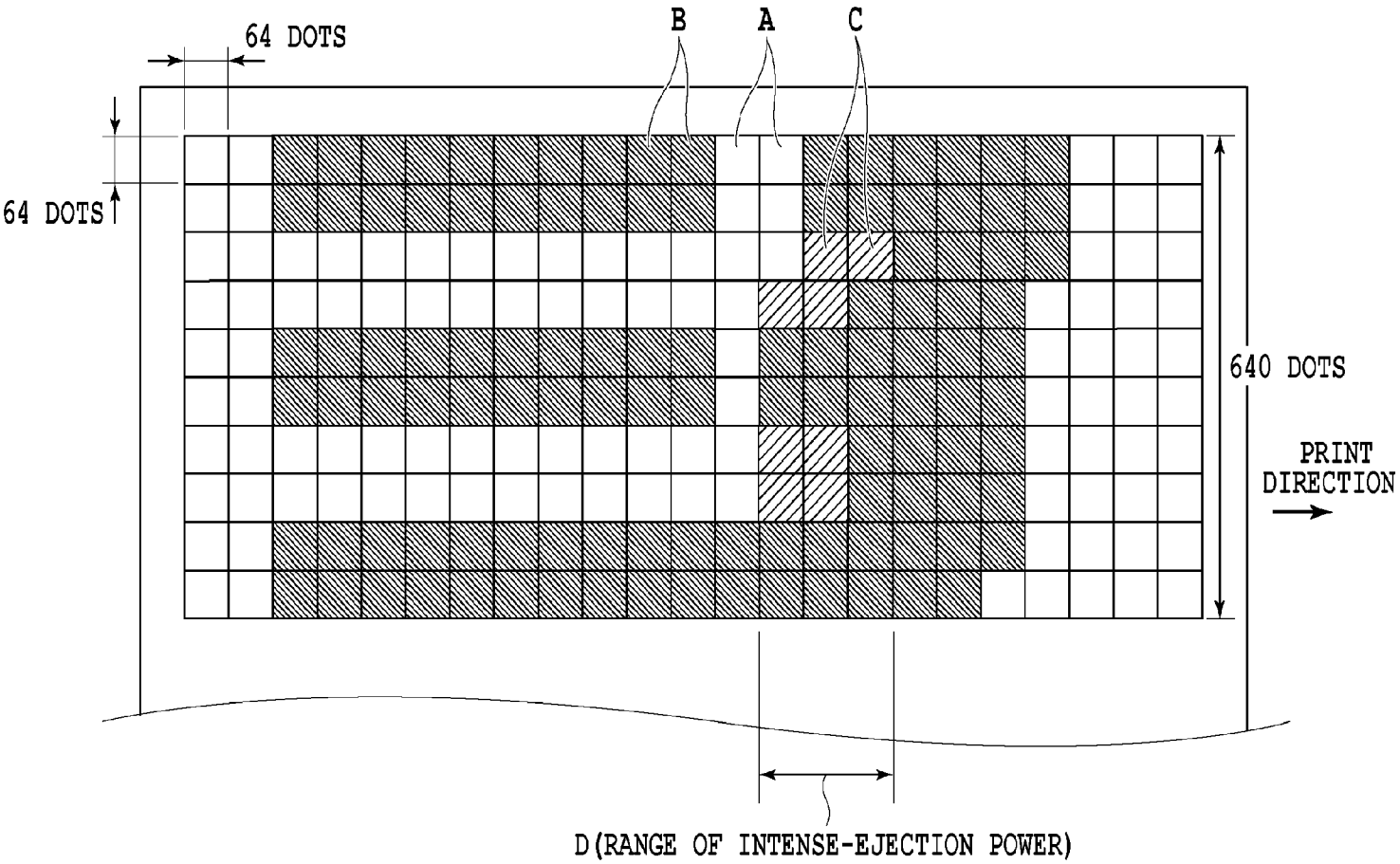
FIG. 15 is a diagram of the range of application of intense-ejection power determined based on data shown in FIG. 14.

In step S15 in FIG. 8B, the range of application of intense-ejection power D is determined based on the areas of expected occurrence of defective ejection C determined by the above-described processing and on a controllable unit of the heat pulse. In the present example, the heat pulse which drives the heaters for the nozzles can be controlled for a plurality of nozzles for each ink color. A range equivalent to 640 dots in the sub-scan direction needs to be set as a unit in order to allow a plurality of nozzles corresponding to one ink color to be controlled. If the range of 640 dots in the sub-scan direction is set as a modulatable unit of the heat pulse, the range of application of intense-ejection power D is determined as shown in FIG. 15 based on the areas of expected occurrence of defective ejection C in FIG. 14. In order to eliminate the defective ejection of the ink from the nozzles, pulse table 8 in FIG. 5 described above is used within the range of application of intense ejection power determined as described above.

Figure 16:
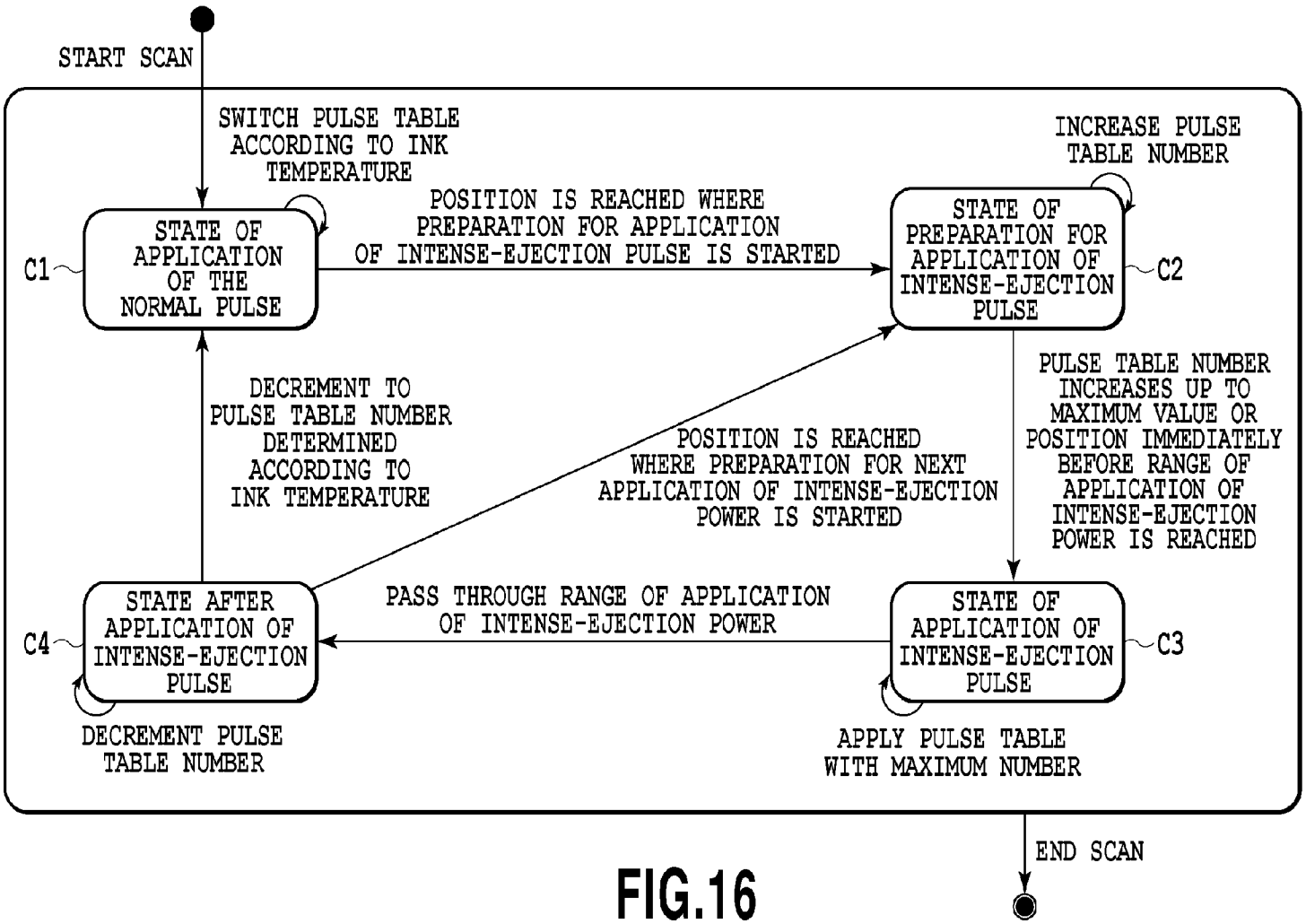
FIG. 16 is a diagram illustrating the transition of the state of application of a pulse table.
Figure 17:
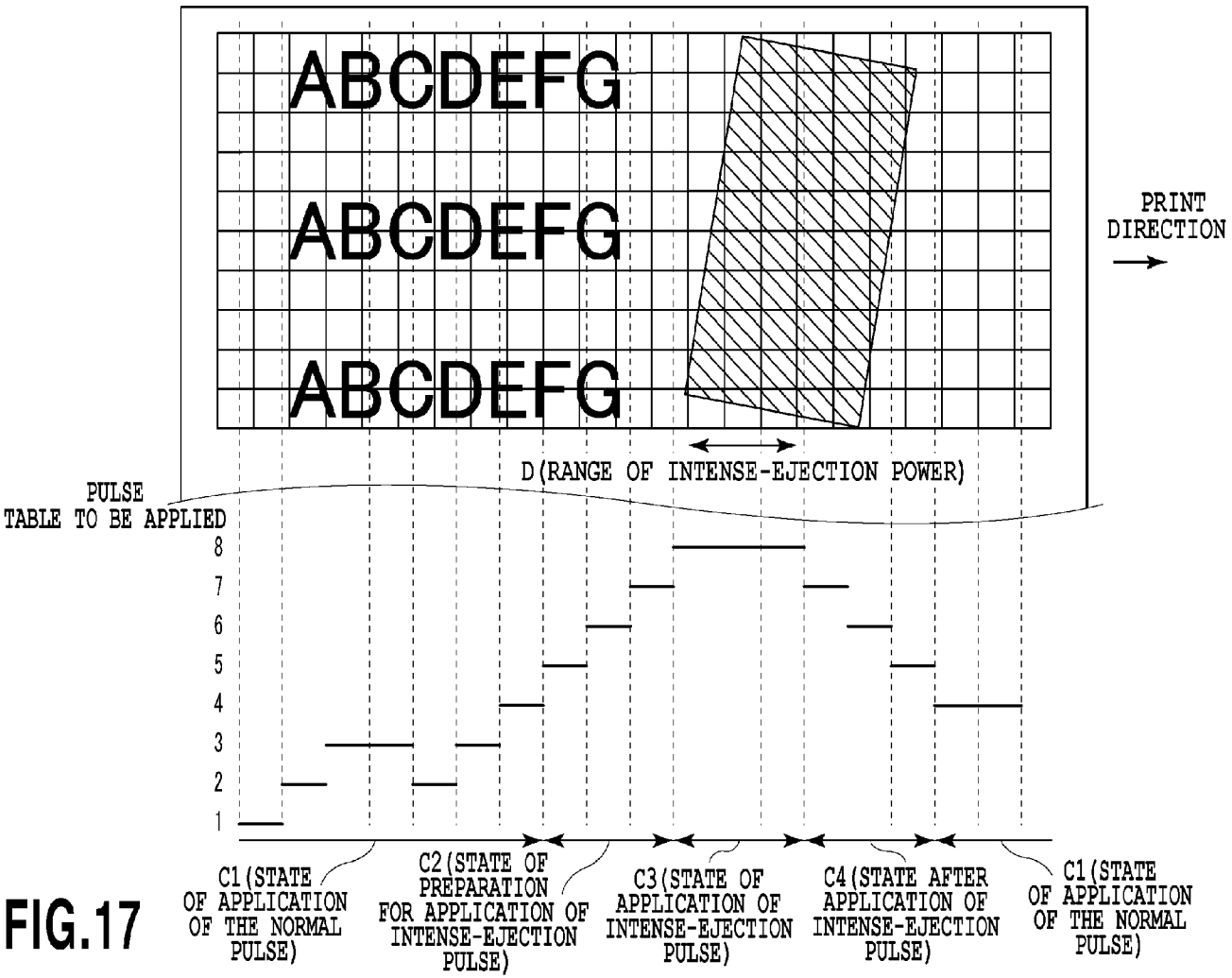
FIG. 17 is a diagram illustrating the pulse tables used, in a switchable manner, for the image data shown in FIG. 9.

FIG. 16 is a diagram illustrating a transition observed if the pulse tables are used to modulate the heat pulse. During a scan (print scan), the ink ejection state during the scan can be stabilized by using the pulse tables to modulate the heat pulse. In the present example, during a scan, the pulse tables are used to modulate the heat pulse every 4 ms. At this time, the state in which the heat pulse is applied is transitioned as shown in FIG. 16, and the manner of switching the pulse table is changed depending on the state. FIG. 17 is a diagram illustrating the manner of switching the pulse table when the image shown in FIG. 9 is printed. Vertical dotted lines in FIG. 17 indicate timings at intervals of 4 ms when the pulse table is switched. In the present example, pulse table 8 is used for the area of application of intense ejection power D shown in FIG. 15 as described above. The switching of the heat pulse will be described below in further detail with reference to FIG. 16 and FIG. 17.

In FIG. 16, when a scan is started, the heat pulse is in a state C1 in which a normal pulse is applied (the state of application of the normal pulse) C1. In the state C1, the pulse table is switched depending on the ink temperature so as to keep the ink ejection volume constant regardless of the temperature of the ink in the print head. In the present example, in the state C1 shown in FIG. 17, pulse tables 1 to 5 for normal use (FIG. 5) are switched from one to another according to the ink temperature.

Within the range of application of intense-ejection power D, that is, in a state C3 in which intense ejection pulse is applied as a heat pulse, a variation in ink ejection volume is taken into account when the pulse table is switched. For example, when pulse table 8 (first energy amount) is applied; sudden switching from a pulse table for normal use (second energy amount) to pulse table 8 may cause a rapid change in ink ejection volume. That is, such a rapid change in heat pulse may cause a rapid change in image quality, which is viewed as density unevenness. Thus, a state C2 in which intense ejection pulse is prepared for application is provided for the period of transition between the state C1 in which the normal pulse is applied and the state C3 in which the intense ejection pulse is applied as a heat pulse (this state corresponds to the range of application of intense-ejection power D). This allows the pulse tables to be switched in stages. The switching of the pulse table for each predetermined print area allows a rapid change in ink ejection volume to be prevented.

As shown in FIG. 16, the state of application of the normal pulse C1 transitions to the state of preparation for application of the intense-ejection pulse C2 when the print position of the nozzles reaches a position where the preparation of the intense ejection pulse for application is started. The position where the preparation of the intense ejection pulse for application is started is determined according to the number of stages between the pulse table applied in the state of application of the normal pulse C1 and the pulse table applied in the state of application of the intense-ejection pulse C3 (in the present example, pulse table 8). In the state of preparation for application of the intense-ejection pulse C2, the pulse table number is incremented by 1 at time intervals of 4 ms. The state of preparation for application of the intense-ejection pulse C2 uses not only pulse tables 1 to 5 for normal use but also pulse tables 6 to 8.

In the above description, the shift amount by which the pulse table number is incremented is 1. However, the shift amount can be set as appropriate according to the number of passes or the print speed. For example, if the print speed is high as shown in FIG. 18, the shift amount is 2. This is because the print area in the state of preparation for application of the intense-ejection pulse increases when the shift amount is small if the print speed is high.

FIG. 16 indicates that the condition for a transition from the state of preparation for application of the intense-ejection pulse C2 to the state of application of the intense-ejection pulse C3 is that "the pulse table number increases up to its maximum value" or that a "position immediately before the range of application of intense-ejection power is reached". The latter condition that the "position immediately before the range of application of intense-ejection power is reached" takes into account the case where the print start position is in proximity to the range of application of intense-ejection power D, preventing provision of a sufficient number of stages for allowing the pulse table to be switched in stages. The maximum value of the pulse table number is "8", and thus pulse table 8 is applied to the range of application of intense-ejection power D.

In FIG. 16, after the range of application of intense-ejection power D is passed, the state of application of the intense-ejection pulse C3 transitions to a state after application of the intense-ejection pulse C4. If the state C3 in which pulse table 8 is applied returns suddenly to the state of application of the normal pulse C1, in which the pulse table for normal use is applied, this may appear as a rapid change in the image quality of the print image. To avoid this, the state after application of the intense-ejection pulse C4 is provided to allow the pulse table to return in stages to the pulse table for normal use. In the state after application of the intense-ejection pulse C4, the pulse table number is decremented at time intervals of 4 ms as shown in FIG. 17. The shift amount by which the number of pulse table is decremented can be set as appropriate as is the case with the increment in the pulse table number. In FIG. 16, when the pulse table number decrements to the number determined by the ink temperature, the state after application of the intense-ejection pulse transitions C4 to the state of application of the normal pulse C1. In some situations, the state after application of the intense-ejection pulse transitions C4 may transition to the state of preparation for application of the intense-ejection pulse C2. For example, depending on the image data, one scan may involve a plurality of ranges of application of intense-ejection power D. If these ranges of application of intense-ejection power D are in proximity to one another, the position where preparation for the next application of the intense-ejection pulse is started may be reached during the state after application of the intense-ejection pulse C4. In this case, the state after application of the intense-ejection pulse C4 transitions to the state of preparation for application of the intense-ejection pulse C2.

Thus, the provision of the state of preparation for application of the intense-ejection pulse C2 and the state after application of the intense-ejection pulse C4 allows the intense-ejection power to be applied to the heaters in the areas C (FIG. 14), in which defective ejection is expected to occur, while restraining image quality from being affected by a rapid change in heat pulse.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-052894, filed Mar. 9, 2012, which is hereby incorporated by reference herein in its entirety.

What is claimed:

1. A inkjet printing apparatus for printing image on a printing medium, comprising:

a print head having a printing element array in which a plurality of printing elements for generating energy to eject ink by being applied driving pulse are arranged in an arraying direction;

a scanning unit configured to cause the print head to scan to the printing medium relatively in a scanning direction which crosses to the arraying direction;

a first obtaining unit configured to obtain an information regarding ink ejection amounts to each of a plurality of dividing areas on the basis of a print data used for printing, the plurality of dividing areas being obtained by dividing the printing medium in the arraying direction and the scanning direction;

a first judging unit configured to, with respect to each of the plurality of dividing areas, judge the dividing area where the ink ejection amount is lower than a first threshold value as a first dividing area, and the dividing area where the ink ejection amount is higher than the first threshold value as a second dividing area;

a second obtaining unit configured to, with respect to each of the dividing areas judged as the second dividing area, obtain an information regarding continuous number for target second dividing area, wherein the continuous number is defined number of dividing areas which are judged as the first dividing area, and which are continued to an upstream side in the scanning direction to the target second dividing area;

a second judging unit configured to judge the target second dividing area as a third dividing area in a case where the continuous number for the target second dividing area is larger than a second threshold value; and a controlling unit configured to control ejecting ink by applying the driving pulse to the plurality of printing elements on the basis of the print data while the print head is scanning, wherein the controlling unit controls ejecting ink by applying the driving pulse to the plurality of printing elements such that (i) an amount of energy to be applied to the plurality of printing elements at a timing of ejecting ink to a first area which includes the dividing area judged as the third dividing area is a first amount, and (ii) an amount of energy to be applied to the plurality of printing elements at a timing of ejecting ink to a second area whose position is different from a position of the first area in the scanning direction is a second amount which is lower than the first amount.

2. The inkjet printing apparatus according to claim 1, further comprising:

a determining unit configured to determine one of the driving pulse among N number of driving pulses, each comprising a pre-pulse and a main pulse applied after the pre-pulse, at predetermined time intervals, the N number of driving pulses being comprised from K number of driving pulses whose pulse widths of the pre-pulses are shorter than a predetermined width and N-K number of driving pulses whose pulse widths of the pre pulses are longer than the predetermined width, wherein the determining unit determines the one of the driving pulses so as to (i) determine a first driving pulse as the one of the driving pulses among the N-K number of driving pulses at the timing of ejecting ink to the first area, and (ii) determine the one of the driving pulses among the K number of driving pulses at the timing of ejecting ink to the second area, and the controlling unit controls ejecting ink by applying the driving pulse determined by the determining unit to the plurality of printing elements.

3. The inkjet printing apparatus according to claim 1, wherein the print head has a first printing element array for ejecting a first color ink and a second printing element array for ejecting a second color ink whose color is different from the first color ink, and the second judging unit uses (i) a first value as the second threshold value in a case where the first printing element array ejects the first color ink, and (ii) a second value which is different from the first value as the second threshold value in a case where the second printing element array ejects the second color ink.

4. The inkjet printing apparatus according to claim 1, wherein the inkjet printing apparatus is able to perform printing according to a first printing mode for printing an image on an unit area in the printing medium by a first time of scanning of the print head by the scanning unit, and a second printing mode for printing an image on the unit area in the printing medium by a second time, which is larger than the first time, of scanning of the print head by the scanning unit, and the second judging unit uses (i) a third value as the second threshold value in a case where the inkjet printing apparatus performs printing according to the first printing mode, and (ii) a fourth value which is lower than the third value as the second threshold value in a case where the inkjet printing apparatus performs printing according to the second printing mode.

5. The inkjet printing apparatus according to claim 1, wherein the inkjet printing apparatus is able to perform printing according to a third printing mode for printing an image by scanning of the print head at first speed by the scanning unit, and a fourth printing mode for printing an image by scanning of the print head at second speed, which is faster than the first speed, by the scanning unit, and the second judging unit uses (i) a fifth value as the second threshold value in a case where the inkjet printing apparatus performs printing according to the third printing mode, and (ii) a sixth value which is higher than the fifth value as the second threshold value in a case where the inkjet printing apparatus performs printing according to the fourth printing mode.

6. The inkjet printing apparatus according to claim 1, wherein the second judging unit further judges predetermined number of the dividing areas, which is continued to a downstream side in the scanning direction to the target second dividing area, as the third dividing areas in a case where the continuous number for the target second dividing area indicated by the information obtained by the second obtaining unit is larger than the second threshold value.

7. The inkjet printing apparatus according to claim 6, wherein the print head has a first printing element array for ejecting a first color ink and a second printing element array for ejecting a second color ink whose color is different from the first color ink, and the second judging unit uses (i) a seventh value as the predetermined number in a case where the first printing element array ejects the first color ink, and (ii) an eighth value which is different from the seventh value as the predetermined number in a case where the second printing element array ejects the second color ink.

8. The inkjet printing apparatus according to claim 6, wherein the inkjet printing apparatus is able to perform printing according to a first printing mode for printing an image on an unit area in the printing medium by a first time of scanning of the print head by the scanning unit, and a second printing mode for printing an image on the unit area in the printing medium by a second time, which is larger than the first times, of scanning of the print head by the scanning unit, and the second judging unit uses (i) a ninth value as the predetermined number in a case where the inkjet printing apparatus performs printing according to the first printing mode, and (ii) a tenth value which is lower than the ninth value as the predetermined number in a case where the inkjet printing apparatus performs printing according to the second printing mode.

9. The inkjet printing apparatus according to claim 6, wherein the inkjet printing apparatus is able to perform printing according to a third printing mode for printing an image by scanning of the print head at first speed by the scanning unit, and a fourth printing mode for printing an image by scanning of the print head at second speed, which is faster than the first speed, by the scanning unit, and the second judging unit uses (i) an eleventh value as the predetermined number in a case where the inkjet printing apparatus performs printing according to the third printing mode, and (ii) a twelfth value which is higher than the eleventh value as the predetermined number in a case where the inkjet printing apparatus performs printing according to the fourth printing mode.

10. The inkjet printing apparatus according to claim 2, further comprising a third obtaining unit configured to obtain an information regarding temperature of the print head, wherein the determining unit determines the one of driving pulses among the K number of driving pulses on the basis of the temperature indicated by the information obtained by the third obtaining unit at the timing of ejecting ink to the second area.

11. The inkjet printing apparatus according to claim 10, wherein the determining unit determines (i) a second driving pulse as the one of driving pulses at the timing of ejecting ink to the second area in a case where the temperature indicated by the information obtained by the third obtaining unit is a first temperature, and (ii) a third driving pulse, which is shorter than the second driving pulse, as the one of driving pulses at the timing of ejecting ink to the second area in a case where the temperature indicated by the information obtained by the third obtaining unit is a second temperature which is higher than the first temperature.

12. The inkjet printing apparatus according to claim 2, wherein the determining unit determines the one of driving pulses among a plurality of driving pulses which is included in the N-K number of driving pulse and whose pulse width of the pre-pulse are shorter than the pulse width of the pre-pulse of the first driving pulse at a timing of ejecting to a third area which positioned between a position of the first area and a position of the second area in the scanning direction.

13. The inkjet printing apparatus according to claim 2, wherein the first driving pulse has the longest pulse width of the pre-pulse among the N number of the driving pulse.

14. The inkjet printing apparatus according to claim 1, wherein a length of each of the plurality of the dividing areas in the arraying direction is shorter than a length of the printing element array in the arraying direction.

15. The inkjet printing apparatus according to claim 1, wherein the first obtaining unit obtains an information regarding number of dot to be printed to each of the plurality of dividing areas as the information regarding ink ejection amount to each of the plurality of dividing areas.

16. The inkjet printing apparatus according to claim 1, wherein the first judging unit judges, with respect to each of the plurality of dividing areas, the dividing area where the ink ejection amount indicated by the information obtained by the first obtaining unit is zero as the first dividing area, and the dividing area where the ink ejection amount indicated by the information obtained by the first obtaining unit is larger than zero as the second dividing area.

17. A inkjet printing method for printing image on a printing medium by using a print head having a printing element array in which a plurality of printing elements for generating energy to eject ink by being applied driving pulse are arranged in an arraying direction, the method comprising;

a scanning step of causing the print head to scan to the printing medium relatively in a scanning direction which crosses to the arraying direction;

a first obtaining step of obtaining an information regarding ink ejection amounts to each of a plurality of dividing areas on the basis of a print data used for printing, the plurality of dividing areas being obtained by dividing the printing medium in the arraying direction and the scanning direction;

a first judging step of judging, with respect to each of the plurality of dividing areas, the dividing area where the ink ejection amount is lower than a first threshold value as a first dividing area, and the dividing area where the ink ejection amount is higher than the first threshold value as a second dividing area;

a second obtaining step of obtaining, with respect to each of the dividing areas judged as the second dividing area, an information regarding continuous number for target second dividing area, wherein the continuous number is defined number of dividing areas which are judged as the first dividing area, and which are continued to an upstream side in the scanning direction to the target second dividing area;

a second judging step of judging the target second dividing area as a third dividing area in a case where the continuous number for the target second dividing area is larger than a second threshold value; and a controlling step of controlling ejecting ink by applying the driving pulse to the plurality of printing elements on the basis of the print data while the print head is scanning, wherein ejecting ink by applying the driving pulse to the plurality of printing elements is controlled such that (i) an amount of energy to be applied to the plurality of printing elements at a timing of ejecting ink to a first area which includes the dividing area judged as the third dividing area is a first amount, and (ii) an amount of energy to be applied to the plurality of printing elements at a timing of ejecting ink to a second area whose position is different from a position of the first area in the scanning direction is a second amount which is lower than the first amount.

* * * * *